US006623589B2

(12) United States Patent
Sogabe et al.

(10) Patent No.: US 6,623,589 B2
(45) Date of Patent: Sep. 23, 2003

(54) COLOR THERMAL TRANSFER RECORDING MEDIUM

(75) Inventors: Jun Sogabe, Osaka-shi (JP); Fumio Uetsuji, Osaka-shi (JP); Yoshiyuki Asabe, Tokyo-to (JP); Yasutoshi Inoue, Tokyo-to (JP)

(73) Assignees: Fujicopian Co., Ltd., Osaka-Fu (JP); Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/898,246

(22) Filed: Jul. 3, 2001

(65) Prior Publication Data

US 2002/0127377 A1 Sep. 12, 2002

(30) Foreign Application Priority Data

Jul. 3, 2000 (JP) ..... 2000-201375

(51) Int. Cl.[7] ..... B41M 5/30
(52) U.S. Cl. ..... 156/235; 428/195
(58) Field of Search ..... 428/195, 484, 428/488.1, 488.4, 913, 914; 156/235

(56) References Cited

U.S. PATENT DOCUMENTS

| | | | | |
|---|---|---|---|---|
| 5,002,819 A | | 3/1991 | Tohma et al. | 428/212 |
| 5,053,267 A | | 10/1991 | Ide et al. | 428/195 |
| 5,264,279 A | | 11/1993 | Imamura et al. | 428/323 |
| 5,654,080 A | | 8/1997 | Hayashi et al. | 428/198 |
| 5,843,563 A | * | 12/1998 | Tuyuguchi et al. | 428/212 |
| 5,856,269 A | | 1/1999 | Hayashi et al. | 503/227 |
| 6,231,973 B1 | | 5/2001 | Suematsu et al. | 428/346 |

FOREIGN PATENT DOCUMENTS

| | | |
|---|---|---|
| EP | 0 510 661 A1 | 10/1992 |
| EP | 0 698 504 A1 | 2/1996 |
| EP | 0 799 714 A1 | 10/1997 |
| JP | 06-015971 | 1/1994 |
| JP | 07-314906 | 12/1995 |
| JP | 10-329435 | 12/1998 |
| JP | 11-208130 | 8/1999 |

* cited by examiner

*Primary Examiner*—Bruce H. Hess
(74) *Attorney, Agent, or Firm*—Firsh & Neave

(57) ABSTRACT

A color thermal transfer recording medium for forming a multi-color image by superimposing printing of a plurality of different color inks wherein transfer layers corresponding to a plurality of colors to be superimposed are provided on separate substrates or on a single substrate in a side-by-side relation, the transfer layers each comprising at least a release layer, a color ink layer and an adhesive layer stacked in this order from the substrate side, the release layer comprising a wax material as a main component by weight, the adhesive layer comprising a binder comprising a thermoplastic resin as a main component by weight and particles dispersed in the binder, wherein the thickness $d1$ of a release layer for a first color; the thickness $d2$ of a color ink layer for a second color; the thickness $d3$ of an adhesive layer for a second color; and the average particle size R of the particles contained in the adhesive layer for the second color satisfy the following relation:

$$(d1+d2+d3)\times 2>R>d1+d3 \quad \text{(I).}$$

8 Claims, 2 Drawing Sheets

COLOR THERMAL TRANSFER RECORDING MEDIUM

BACKGROUND OF THE INVENTION

The present invention relates to a thermal transfer recording medium for forming a multi-color image by superimposing printing of a plurality of colored inks.

Hitherto, the formation of a multi-color image (including a full-color image, hereinafter the same) has been carried out by superimposing a plurality of heat-sensitive color inks on an image receiving sheet with use of a thermal transfer printer or the like. Also, as a thermal transfer recording medium for this purpose, those having a structure in which a release layer composed of a wax as a main component is provided between a substrate and a color ink layer in order to provide excellent transferability have widely been used.

However, in the case that a multi-color image is formed by superimposing a plurality of different color inks using thermal transfer recording media with the foregoing structure, the release layer composed of mainly a wax would exist on the top of first color ink dots formed on an image receiving sheet, and as a result, at the time of transferring second color ink dots, there takes place a problem that the release layer composed mainly of a wax on the top of the first color ink dots is melted so that the second color ink dots do not satisfactorily adhere to the first color ink dots.

In view of the aforesaid problem of the prior art in the case of forming a multi-color image by superimposing printing of a plurality of different color inks using thermal transfer recording media each having a structure in which a release layer composed of a wax as a main component is provided between a substrate and a color ink layer in order to provide excellent transferability, it is an object of the present invention to provide a thermal transfer recording medium or a combination of thermal transfer recording media capable of satisfactorily transferring second color ink dots onto first color ink dots.

Another object of the present invention is to provide a method for forming a multi-color image using the forgoing thermal transfer recording medium or combination of thermal transfer recording media.

These and other objects of the present invention will become apparent from the description hereinafter.

SUMMARY OF THE INVENTION

According to a first aspect of the present invention, there is provided a color thermal transfer recording medium for forming a multi-color image by superimposing printing of a plurality of different color inks, comprising a substrate, and at least a first color transfer layer and a second color transfer layer provided on the substrate in a side-by-side relation, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I).}$$

According to a second aspect of the present invention, there is provided a combination of a plurality of color thermal transfer recording media for forming a multi-color image by superimposing printing of a plurality of different color inks, comprising at least a first color thermal transfer recording medium and a second color thermal transfer recording medium, the first color thermal transfer recording medium comprising a first substrate and a first color transfer layer provided on the first substrate, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color thermal transfer recording medium comprising a second substrate and a second color transfer layer provided on the second substrate, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I).}$$

According to a third aspect of the present invention, there is provided a method for forming a multi-color image by superimposing printing of a plurality of different color inks, comprising the steps of:

providing a color thermal transfer recording medium comprising a substrate, and at least a first color transfer layer and a second color transfer layer provided on the substrate in a side-by-side relation, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I).}$$

conducting a thermal transfer using the first transfer layer to foam a first color image, and conducting a thermal transfer using the second transfer layer to form a second color image on the first color image.

According to a fourth aspect of the present invention, there is provided a method for forming a multi-color image by superimposing printing of a plurality of different color inks, comprising the steps of:

providing a combination of a plurality of color thermal transfer recording media comprising at least a first color thermal transfer recording medium and a second color thermal transfer recording medium, the first color thermal transfer recording medium comprising a first substrate and a first color transfer layer provided on the substrate, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color thermal transfer recording medium comprising a second substrate and a second color transfer layer provided on the second substrate, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I).}$$

conducting a thermal transfer using the first color transfer layer of the first color thermal transfer medium to foam a first color image, and conducting a thermal transfer using the second color transfer layer of the second color thermal transfer medium to form a second color image on the first color image.

DETAILED DESCRIPTION

Embodiments of the color thermal transfer recording medium of the present invention include one wherein transfer layers corresponding to a plurality of colors to be superimposed are provided on separate substrates, respectively, and another wherein transfer layers corresponding to a plurality of colors to be superimposed are provided on a single substrate in a side-by-side relation. In the former embodiment, transfer layers corresponding to a plurality of colors, for example, a transfer layer for yellow (Y), a transfer layer for magenta (M), a transfer layer for cyan (C), and if necessary, a transfer layer for black (BK), are respectively provided on separate substrates. In the latter embodiment, transfer layers corresponding to a plurality of colors, for example, a transfer layer for yellow (Y), a transfer layer for magenta (M), a transfer layer for cyan (C), and if necessary, a transfer layer for black (BK), are arranged repeatedly on a single substrate in the longitudinal direction thereof. Hereinafter, the color thermal transfer recording medium of the present invention refers to both the foregoing embodiments unless otherwise noted.

Figure 1A:
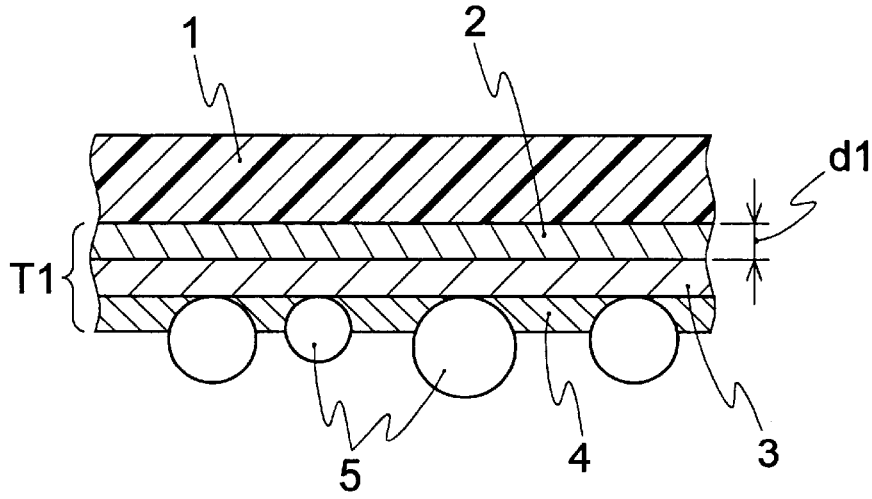
FIG. 1 is a schematic partial sectional view showing an example of a thermal transfer recording medium in accordance with the present invention, and FIG. 1(*a*) shows a first color thermal transfer recording medium and FIG. 1(*b*) shows a second color thermal transfer recording medium.
Figure 1B:
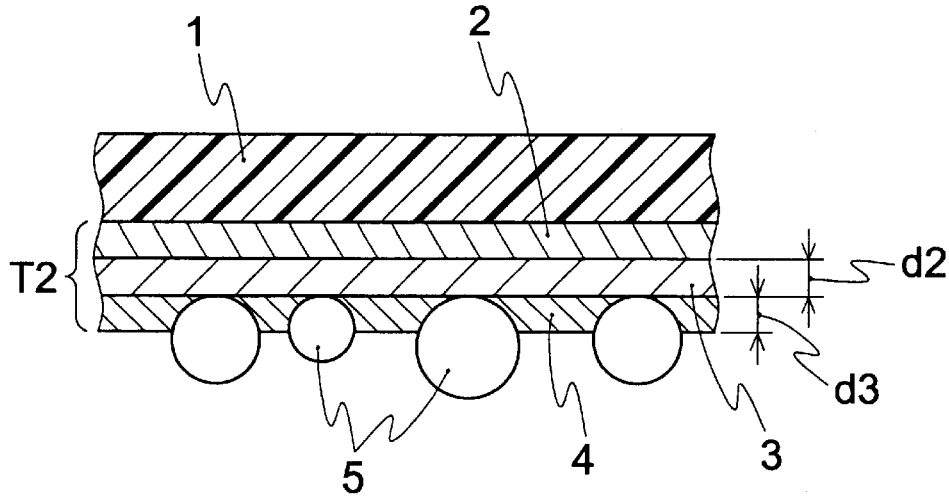
Figure 2:
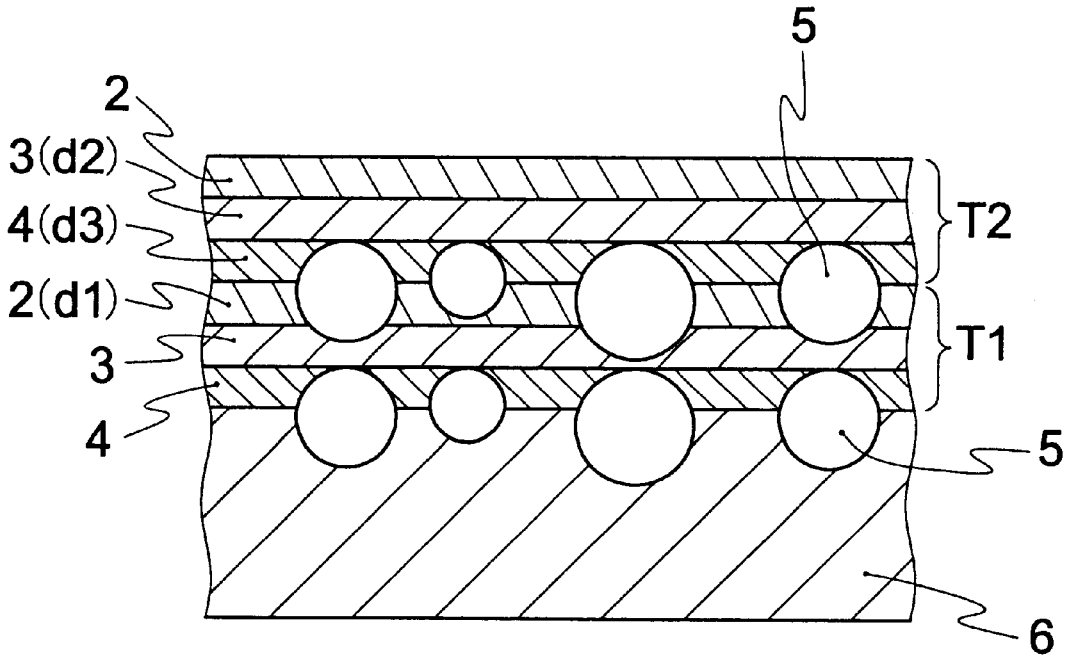
FIG. 2 is a schematic partial sectional view showing a state where superimposing printing is carried out on an image receptor using a thermal transfer recording media in accordance with the present invention.

The color thermal transfer recording medium of the present invention will be described by referring to the accompanying drawings. FIGS. 1(*a*) and 1(*b*) are schematic partial sectional views showing an example of a combination of thermal transfer recording media in accordance with the present invention. FIG. 2 is a schematic partial sectional view showing a state where superimposing printing is carried out on an image receptor using a combination of thermal transfer recording media in accordance with the present invention.

FIGS. 1(*a*) and 1(*b*) respectively show a first color thermal transfer recording medium having a first color transfer layer and a second color thermal transfer recording medium having a second color transfer layer. In FIG. 1(*a*), reference numeral 1 denotes a substrate (first substrate), and a first color transfer layer T1 is provided on the substrate 1. The first color transfer layer T1 has a structure wherein a release layer 2 (first release layer 2), a color ink layer 3 (first color ink layer 3 ) and an adhesive layer 4 (first adhesive layer 4) are stacked in this order from the substrate side, and the adhesive layer 4 contains particles 5. In FIG. 1(*b*), reference numeral 1 denotes a substrate (second substrate), and a second color transfer layer T2 is provided on the substrate 1. The second color transfer layer T2 has a structure wherein a release layer 2 (second release layer 2), a color ink layer 3 (second color ink layer 3) and an adhesive layer 4 (second adhesive layer 4) are stacked in this order from the substrate side, and the adhesive layer 4 contains particles 5. Although the first color transfer layer T1 and the second color transfer layer T2 are respectively provided on separate substrates in the embodiment shown in FIGS. 1(*a*) and 1(*b*), the first color transfer layer T1 and the second color transfer layer T2 may be provided on a single substrate in another embodiment.

The definition of the terms "first color" and "second color" in the present invention is as follows: When two different color inks are superimposingly printed one onto the other, the one color which is transferred previous to the other color refers to "first color", and the other color which is superimposingly transferred onto the first color refers to "second color". For example, in the case of superimposingly printing three different color inks of yellow (Y), magenta (M) and cyan (C) in the order of Y, M and C, Y is a first color and M is a second color when the transfer of Y and M is considered, and M is a first color and C is a second color when the transfer of M and C is considered.

Consequently, the respective colors for the first color transfer layer T1 and the second color transfer layer T2, that is, the respective colors of the first color ink layer included in the first color transfer layer T1 and the second color ink layer included in the second color transfer layer T2, are appropriately selected from a plurality of colors to be superimposed, for example, yellow (Y), magenta (M), cyan (C), and if necessary, black (BK).

The definition of the terms "first release layer" and "second release layer", and "first adhesive layer" and "second adhesive layer" is as follows: The release layer which is included in the first color transfer layer T1 refers to "first release layer" and the release layer which is included in the second color transfer layer T2 refers to "second release layer". The adhesive layer which is included in the first color transfer layer T1 refers to "first adhesive layer" and the adhesive layer which is included in the second color transfer layer T2 refers to "second adhesive layer".

In the present invention, the thickness d1 of the first release layer 2, the thickness d2 of the second color ink layer 3, the thickness d3 of the second adhesive layer 4, and the average particle size R of particles contained in the second adhesive layer 4 satisfy the relation represented by formula (I). Most of the particles 5 contained in the adhesive layer 4 are protruded from the surface of the adhesive layer 4. The thickness d3 of the adhesive layer 4 is the average thickness of the parts of the adhesive layer 4 where none of the particles 5 are protruded from the surface.

In the present invention, it is preferable that a plurality of transfer layers corresponding to a plurality of colors to be superimposed are substantially the same with each other except that the colors of the color ink layers included therein are different from each other. The thicknesses of the release layers, the thicknesses of the color ink layers, and the thicknesses of the adhesive layers may respectively be the same with each other or different from each other among a plurality of transfer layers. However, between two colors to be superimposed, the thickness d1 of the first release layer 2, the thickness d2 of the second color ink layer 3, the thickness d3 of the second adhesive layer 4, and the average particle size R of the particles contained in the second adhesive layer 4 are required to satisfy the relation represented by the above-described formula (I).

When superimposing printing is carried out using the color thermal transfer recording medium with the above-described structure in accordance with the present invention, as shown in FIG. 2, the first color transfer layer T1 is selectively transferred onto an image receptor 6 to form first color ink dots and then the second color transfer layer T2 is selectively transferred to form second color ink dots on the first color ink dots. In this case, the thickness d3 of the second adhesive layer 4 of the second color transfer layer T2, the average particle size R of the particles 5 contained in the second adhesive layer 4, and the thickness d1 of the first release layer 2 as the uppermost layer of the first color ink dots satisfy the relation:

$$R>d1+d3.$$

Consequently, most of the particles 5 protruded from the second adhesive layer 4 thrust through the first release layer 2 (composed of a wax material as a main component) of the first color ink dots and enters in the first color ink layer 3 (in which the binder is usually composed mainly of a thermoplastic resin) of the first color ink dots. Owing to such an anchor effect by the particles, the superimposing of the second color ink dots on the first color ink dots is satisfactorily performed.

On the other hand, if the average particle size R of the particles 5 contained in the second adhesive layer 4 is two or more times as much as the total thickness ($d1+d2+d3$) of the thickness d1 of the first release layer 2, the thickness d2 of the second color ink layer 3, and the thickness d3 of the second adhesive layer 4, the particles markedly protruded from the second adhesive layer 4 of the second color transfer layer T2 become an obstacle and make it difficult to bring the second adhesive layer 4 into contact with the release layer 2 of the first color ink dots at the time of superimposing printing. From such a viewpoint, the thickness d1 of the first release layer, the thickness d2 of the second color ink layer, the thickness d3 of the second adhesive layer, and the average particle size R of the particles contained in the second adhesive layer are required to satisfy the following relation:

$$(d1+d2+d3)\times 2>R.$$

As the color thermal transfer recording medium of the present invention, those which satisfy the above-described conditions can be used without any particular limitation on other constitutions.

For example, as the substrate, a variety of materials conventionally employed as substrates for thermal transfer ink ribbons can be used. Polyester films with 1 to 3 μm thickness and the like are preferable from the viewpoints of the heat resistance, the thermal conduction and the cost, and poly (ethylene terephthalate) film (PET film) is especially preferred. It is preferable to provide a heat resistant lubricating layer (a sticking preventive layer) on the rear side (the side with which a thermal head is brought into a sliding contact) of the substrate.

As the release layer, for example, a layer which is composed of a thermally fusible material containing a wax material as a main component is used. If necessary, the release layer is further incorporated with a thermally fusible resin.

Preferable wax materials as main components are those having a melting point (or softening point) in a range of 60° C. to 120° C. If the melting point (or softening point) is lower than the foregoing range, smearing tends to take place and the storage stability also tends to be deteriorated. On the other hand, if the melting point (or softening point) exceeds the foregoing range, the thermal sensitivity tends to become insufficient.

Examples of the wax materials are natural waxes such as Japan wax, bees wax, carnauba wax, candelilla wax, montan wax, ceresine wax and the like; petroleum waxes such as paraffin wax, microcrystalline wax and the like; synthetic waxes such as oxidized wax, ester wax and the like; and higher fatty acids. These wax materials can be used solely or two or more of them can be used in combination.

The thickness of the release layer is preferably 0.15 to 1.5 μm. If the thickness of the release layer is smaller than the foregoing range, a satisfactory release effect tends to be difficult to obtain and on the other hand, if the thickness exceeds the foregoing range, the transfer sensitivity tends to become insufficient.

As the color ink layer, for example, a layer which is composed of a binder containing a thermoplastic resin as a main component and a coloring agent (a pigment and/or a dye) dispersed in the binder is used. If necessary, the binder may be incorporated with a wax material.

Examples of the thermoplastic resins are olefin based copolymers such as ethylene/vinyl acetate copolymer, polyamide resins, polyester resins, natural rubber, petroleum resins, rosin resins, styrene resins, poly(vinyl alcohol), poly (vinyl butyral), urethane resins, and the like. Further, in order to adjust the layer strength, cellulose resin or epoxy resin may be added. As the wax material, those appropriately selected from the wax materials exemplified for the release layer can be used. These resins or wax materials can be used solely or two or more of them can be used in combination.

As the coloring agents, a variety of pigments and dyes can be used. Examples of the pigments are azo type, phthalocyanine type, quinacridone type, thioindigo type, anthraquinone type, isoindoline type pigments, carbon black, and the like. These coloring agents can be used solely or two or more of them can be used in combination.

The thickness of the color ink layer is preferably 0.2 to 2.0 $\mu$m. If the thickness of the color ink layer is smaller than the foregoing range, the optical density of the color ink layer tends to become insufficient and on the other hand, if the thickness exceeds the foregoing range, the transfer sensitivity tends to be deteriorated.

Next, the adhesive layer, which is one of characteristic constitutions of the present invention, is a layer comprising a binder composed of a thermoplastic resin as a main component and fine particles dispersed in the binder and if necessity, adhesive layer is further incorporated with a coloring agent, a variety of wax materials or the like.

The content of the particles added to the adhesive layer is preferably 5 to 20% by weight. If the content of the particles is less than the foregoing range, the number of the particles protruding from the surface of the adhesive layer is too small to sufficiently achieve the desired effect of the present invention and on the other hand, if the content exceeds the foregoing range, the transfer sensitivity tends to be deteriorated.

As the particles, organic particles and/or inorganic particles may be employed. Examples of the organic particles are resin particles such as styrene resin, methacrylate resin, acrylate resin, melamine resin, epoxy resin, benzoguanarnine resin and the like; and starch, cellulose powder and the like. Examples of the inorganic particles are silica, alumina, diatomaceous earth and the like. However, particles usable for the present invention are not at all limited to these examples. These particles can be used solely or two or more of them may be used in combination.

The thickness of the adhesive layer is preferably 0.2 to 2.0 $\mu$m. If the thickness is smaller than the foregoing range, the adhesive strength is decreased and on the other hand, if it exceeds the foregoing range, the transfer sensitivity tends to be deteriorated.

The average particle size R of the particles is required to satisfy the relation represented by the aforesaid formula (I) and generally preferably within 0.4 to 10 $\mu$m range, more preferably within 0.4 to 5.0 $\mu$m range. If the average particle size is larger than the foregoing ranges, the thickness of the release layer and the thickness of the adhesive layer are required to be larger, resulting in the tendency of transfer sensitivity deterioration. On the other hand, if the average particle size is smaller than the forgoing ranges, the thickness of the release layer and the thickness of the adhesive layer are required to be thinner, resulting in the tendency of difficulty of obtaining satisfactory releasing effect and transferability. Further, if the average particle size of the particles is too large in relation to the thickness of the adhesive layer, the force of binding the particles by the adhesive layer is decreased and the storage stability tends to becomes insufficient. From these viewpoints, the average particle size of the particles is preferably not higher than 10 times as large as the thickness of the adhesive layer.

Further, as the thermoplastic resins and wax materials for the adhesive layer, those which are the same as the thermoplastic resins and wax materials exemplified for the color ink layer may appropriately be selected to be used.

The formation of a multi-color image using the thermal transfer recording medium of the present invention can be performed by usual thermal transfer methods except that the transfer layers are transferred one onto another in such a predetermined transfer order that the transfer layers used satisfy the relation represented by formula (1) with respect to the first color and second color.

The present invention will be more fully described by way of the Examples. It is to be understood that the present invention is not limited to the Examples, and various change and modifications may be made in the invention without departing from the spirit and scope thereof.

EXAMPLE 1

A 2.5 $\mu$m-thick PET film having a 0.2 $\mu$m-thick silicone resin based sticking preventive layer on the rear side was used as a substrate. The following coating liquid for a release layer was applied onto the front side of the substrate and dried to form a 0.5 $\mu$m-thick release layer.

Coating liquid for release layer

| Component | Parts by weight |
|---|---|
| Paraffin wax (melting point: 75° C.) | 7.0 |
| Polyethylene wax (melting point: 100° C.) | 3.0 |
| Toluene | 90.0 |
| Total | 100.0 |

The following coating liquid for an ink layer was applied to the foregoing release layer and dried to form a 0.5 $\mu$m-thick color ink layer.

Coating liquid for ink layer

| Component | Parts by weight |
|---|---|
| Aacrylic resin (softening point: 120° C.) | 6.0 |
| Pigment*1 | 4.0 |
| Dispersant | 0.3 |
| Isopropyl alcohol | 30.0 |
| Toluene | 10.0 |
| Total | 50.3 |

*1Cyan ink ribbon: Phthalocyanine Blue Magenta ink ribbon: Quinacridone Red Yellow ink ribbon: Disazo Yellow Black ink ribbon: carbon black The following coating liquid for an adhesive layer was applied onto the foregoing color ink layer and dried to form a 0.3 μm-thick adhesive layer.

Coating liquid for adhesive layer

| Component | Parts by weight |
|---|---|
| Ethylene/vinyl acetate copolymer*2 | 9.0 |
| Dispersant | 0.3 |
| Silica particles (average particle size: 1.0 μm) | 0.7 |
| Toluene | 40.0 |
| Total | 50.0 |

*2softening point: 63° C.; vinyl acetate content: 28% by weight; and melt flow rate: 150 (hereinafter the same)

Thus a color thermal transfer recording medium comprising four color ink ribbons was obtained.

EXAMPLE 2

A color thermal transfer recording medium comprising four color ink ribbons was obtained in the same manner as in Example 1 except that the thickness of the release layer was changed to 0.3 μm and the following coating liquid for a color ink layer is used to form a 0.3 μm-thick color ink layer.

Coating liquid for ink layer

| Component | Parts by weight |
|---|---|
| Acrylic resin (softening point: 120° C.) | 4.0 |
| Pigment (the same as in Example 1) | 6.0 |
| Dispersant | 0.3 |
| Isopropyl alcohol | 30.0 |
| Toluene | 10.0 |
| Total | 50.3 |

COMPARATIVE EXAMPLE 1

A color thermal transfer recording medium comprising four color ink ribbons was obtained in the same manner as in Example 1 except that the following coating liquid for an adhesive layer was used to form a 0.3 μm-thick adhesive layer.

Coating liquid for adhesive layer

| Component | Parts by weight |
|---|---|
| Ethylene/vinyl acetate copolymer | 9.0 |
| Dispersant | 0.3 |
| Silica particles (average particle size: 0.5 μm) | 0.7 |
| Toluene | 40.0 |
| Total | 50.0 |

COMPARATIVE EXAMPLE 2

A color thermal transfer recording medium comprising four color ink ribbons was obtained in the same manner as in Example 1 except that the thickness of the release layer was changed to 1.0 μm.

COMPARATIVE EXAMPLE 3

A color thermal transfer recording medium comprising four color ink ribbons was obtained in the same manner as in Example 1 except that the following coating liquid for an adhesive layer was used to form a 0.3 μm-thick adhesive layer.

Coating liquid for adhesive layer

| Component | Parts by weight |
|---|---|
| Ethylene/vinyl acetate copolymer | 10.0 |
| Toluene | 40.0 |
| Total | 50.0 |

Evaluation Method

Full-color images were formed under the following printing conditions using the color thermal transfer recording media each comprising four color ink ribbons obtained in the foregoing Examples 1 to 2 and Comparative Examples 1 to 3, and the obtained full-color images were observed with eyes and evaluated according to the following evaluation criteria. The results are shown in Table 1.

Printing conditions:

Printer: a thermal printer (a testing apparatus)

Thermal head: resolution 600 dpi; edge distance 100 μm (real edge)

Printing speed: 24.5 cm/sec

Receptor: Super Mat Art paper (manufactured by Mitsubishi Paper Mills Limited.)

Evaluation pattern: Portrait (ISO/DIS12640 registered data) Evaluation criteria

○: Different color inks are satisfactorily superimposed and an image with smoothness is obtained.

Δ: An image with slight unevenness is obtained.

X: An image with unevenness is obtained.

TABLE 1

| | d1 (μm) | d2 (μm) | d3 (μm) | R (μm) | Content of particles (% by weight) | Evaluation |
|---|---|---|---|---|---|---|
| Ex. 1 | 0.5 | 0.5 | 0.3 | 1.0 | 7.0 | ○ |
| Ex. 2 | 0.3 | 0.3 | 0.3 | 1.0 | 7.0 | ○ |
| Com. Ex. 1 | 0.5 | 0.5 | 0.3 | 0.5 | 7.0 | Δ |
| Com. Ex. 2 | 1.0 | 0.5 | 0.3 | 1.0 | 7.0 | Δ |
| Com. Ex. 3 | 0.5 | 0.5 | 0.3 | — | 0.0 | X |

The present invention makes it possible to provide a thermal transfer recording medium capable of satisfactorily transferring second color ink dots onto first color ink dots in the case of forming a multi-color image by superimposing printing of a plurality of different color inks using thermal transfer recording media having a structure in which a release layer composed of a wax as a main component is provided between a substrate and color ink layers in order to provide excellent transferability.

What is claimed is:

1. A color thermal transfer recording medium for forming a multi-color image by superimposing printing of a plurality of different color inks, comprising a substrate, and at least a first color transfer layer and a second color transfer layer provided on the substrate in a side-by-side relation, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I)}.$$

2. The color thermal transfer recording medium of claim 1, wherein the content of the particles contained in each of the first adhesive layer and the second adhesive layer is from 5 to 20% by weight.

3. A combination of a plurality of color thermal transfer recording media for forming a multi-color image by superimposing printing of a plurality of different color inks, comprising at least a first color thermal transfer recording medium and a second color thermal transfer recording medium, the first color thermal transfer recording medium comprising a first substrate and a first color transfer layer provided on the first substrate, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color thermal transfer recording medium comprising a second substrate and a second color transfer layer provided on the second substrate, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I)}.$$

4. The combination of color thermal transfer recording media of claim 3, wherein the content of the particles contained in each of the first adhesive layer and the second adhesive layer is from 5 to 20% by weight.

5. A method for forming a multi-color image by superimposing printing of a plurality of different color inks, comprising the steps of:

providing a color thermal transfer recording medium comprising a substrate, and at least a first color transfer layer and a second color transfer layer provided on the substrate in a side-by-side relation, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I)},$$

conducting a thermal transfer using the first transfer layer to foam a first color image, and conducting a thermal transfer using the second transfer layer to form a second color image on the first color image.

6. The method for forming a multi-color image of claim 5, wherein the content of the particles contained in each of the first adhesive layer and the second adhesive layer is from 5 to 20% by weight.

7. A method for forming a multi-color image by superimposing printing of a plurality of different color inks, comprising the steps of:

providing a combination of a plurality of color thermal transfer recording media comprising at least a first color thermal transfer recording medium and a second color thermal transfer recording medium, the first color thermal transfer recording medium comprising a first substrate and a first color transfer layer provided on the substrate, the first color transfer layer comprising at least a first release layer, a first color ink layer and a first adhesive layer stacked in this order from the substrate side, the first release layer comprising a wax material as a main component by weight, the first adhesive layer comprising a binder comprising a thermoplastic resin as a main component by weight and particles dispersed in the binder, the second color thermal transfer recording medium comprising a second substrate and a second color transfer layer provided on the second substrate, the second color transfer layer comprising at least a second release layer, a second color ink layer and a second adhesive layer stacked in this order from the substrate side, the second release layer comprising a wax material as a main component by weight, the second adhesive layer comprising a binder comprising a thermoplastic resin as a main component by weight and particles dispersed in the binder, wherein the thickness d1 of the first release layer; the thickness d2 of the second color ink layer; the thickness d3 of the second adhesive layer; and the average particle size R of the particles contained in the second adhesive layer satisfy the following relation:

$$(d1+d2+d3)\times 2>R>d1+d3 \quad \text{(I)},$$

conducting a thermal transfer using the first color transfer layer of the first color thermal transfer medium to foam a first color image, and conducting a thermal transfer using the second color transfer layer of the second color thermal transfer medium to form a second color image on the first color image.

8. The method for forming a multi-color image of claim 7, wherein the content of the particles contained in each of the first adhesive layer and the second adhesive layer is from 5 to 20% by weight.

* * * * *